United States Patent [19]

Epstein

[11] Patent Number: 4,688,405

[45] Date of Patent: Aug. 25, 1987

[54] CONCEALED POST LOCK

[76] Inventor: Norman Epstein, Rte. 301, Carmel, N.Y. 10512

[21] Appl. No.: 689,573

[22] Filed: Jan. 7, 1985

[51] Int. Cl.[4] ..... E05B 73/00

[52] U.S. Cl. ..... 70/14; 70/34; 70/371

[58] Field of Search ..... 70/14, 32, 33, 34, 371, 70/95–100

[56] References Cited

U.S. PATENT DOCUMENTS

| | | | |
|---|---|---|---|
| 2,677,261 | 5/1954 | Jacob | 70/14 |
| 3,423,971 | 1/1969 | Brunelli | 70/231 |

*Primary Examiner*—Robert L. Wolfe

[57] ABSTRACT

A concealed post lock includes an elongated cylindrical post having an enlarged head member secured at one end thereof and at least one locking member movably mounted at the other end thereof. The post contains a lock cylinder which is normally restrained from rotation within said post by locking pins but which are released by insertion of the proper key in the cylinder so that the cylinder may be rotated by the key. The cylinder is operatively coupled to the locking member for moving the locking member between a locked position and an unlocked position when the cylinder is turned within the post. In the unlocked position of the locking member, the locking member is located within the confines of the periphery of the post. In the locked position, the locking member projects outwardly from the periphery of the post. The concealed post lock is sized to be inserted through an opening in a store front gate or other member to be locked with the enlarged head member exposed at the front of the member and the post extending through the opening in said member with the locking member located behind the rear surface of the member, and with the post and locking member concealed and protected by the body of the member to be locked. In one embodiment, the locking member comprises a circular eccentric constituting a terminal continuation of the post, and in another embodiment the locking member comprises a pair of locking pins slidably mounted within the post.

8 Claims, 19 Drawing Figures

FIG. 1
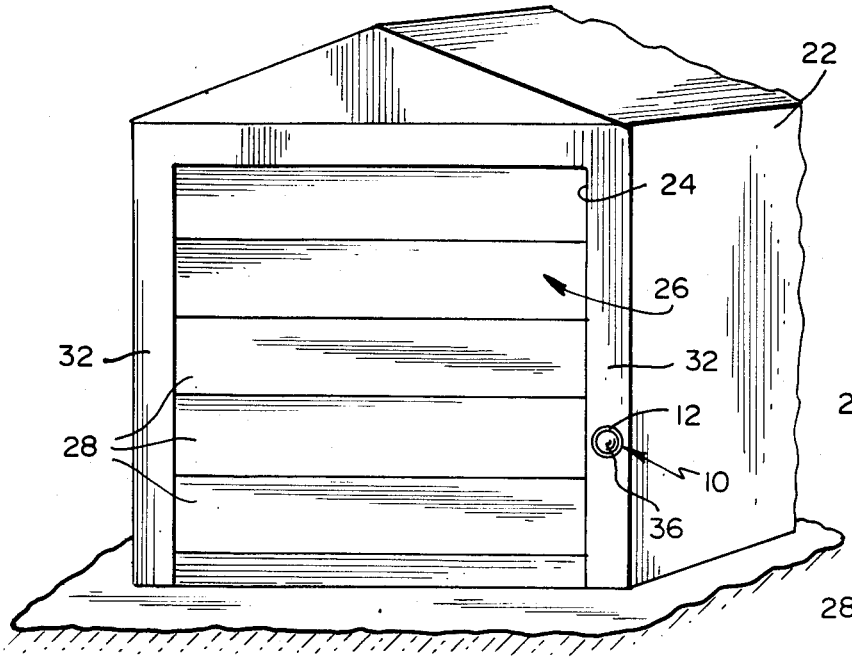
FIG. 1A
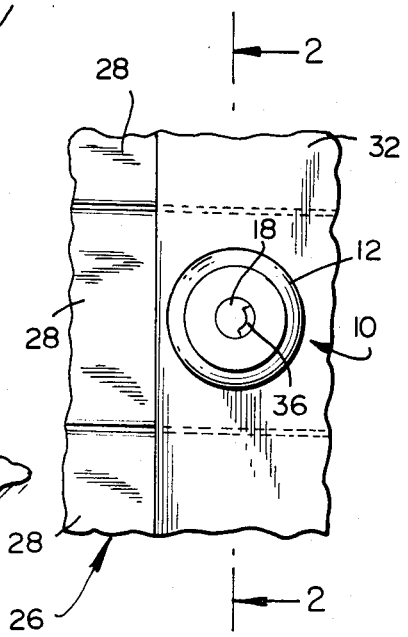
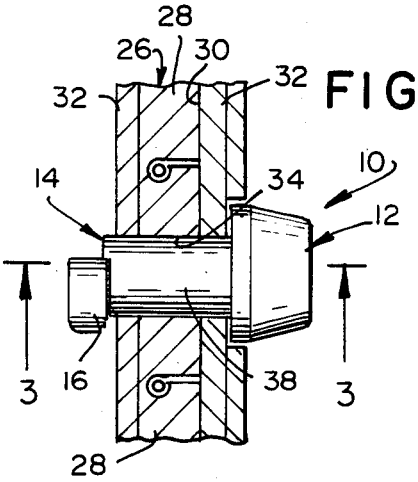
FIG. 2
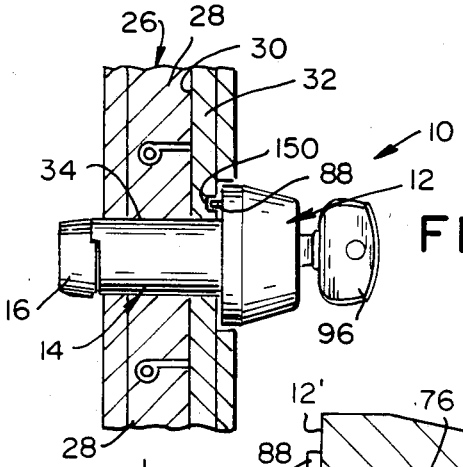
FIG. 2A
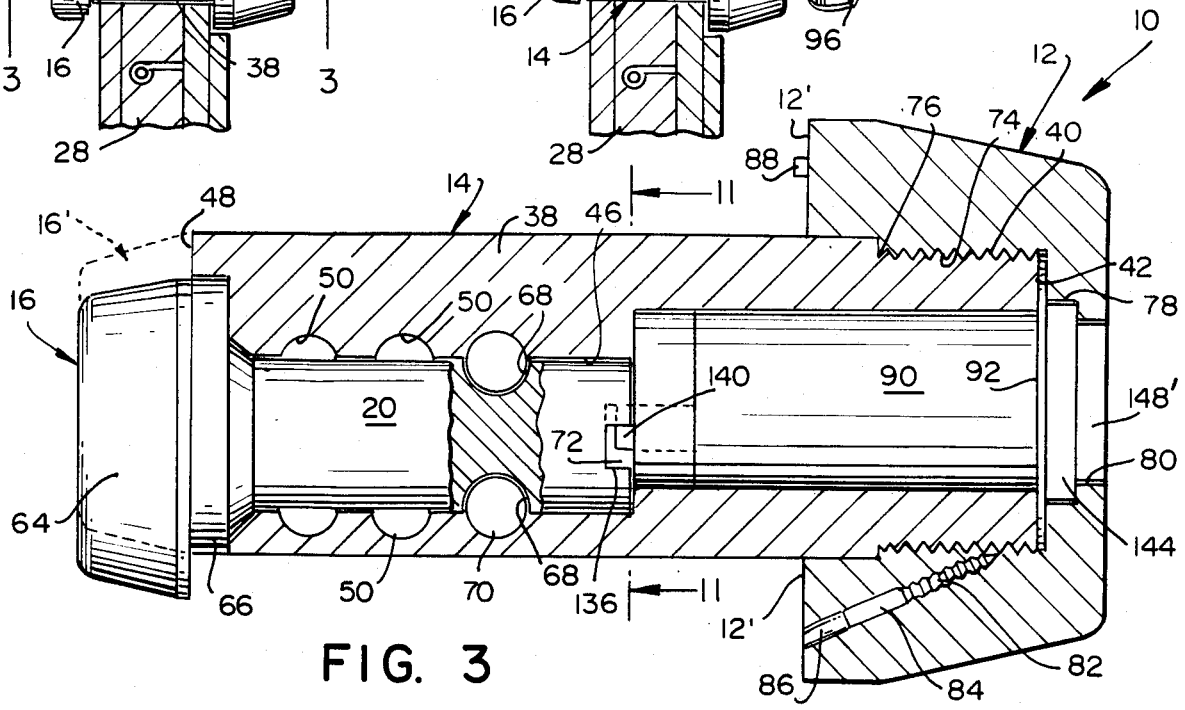
FIG. 3

FIG. IIA

FIG. II

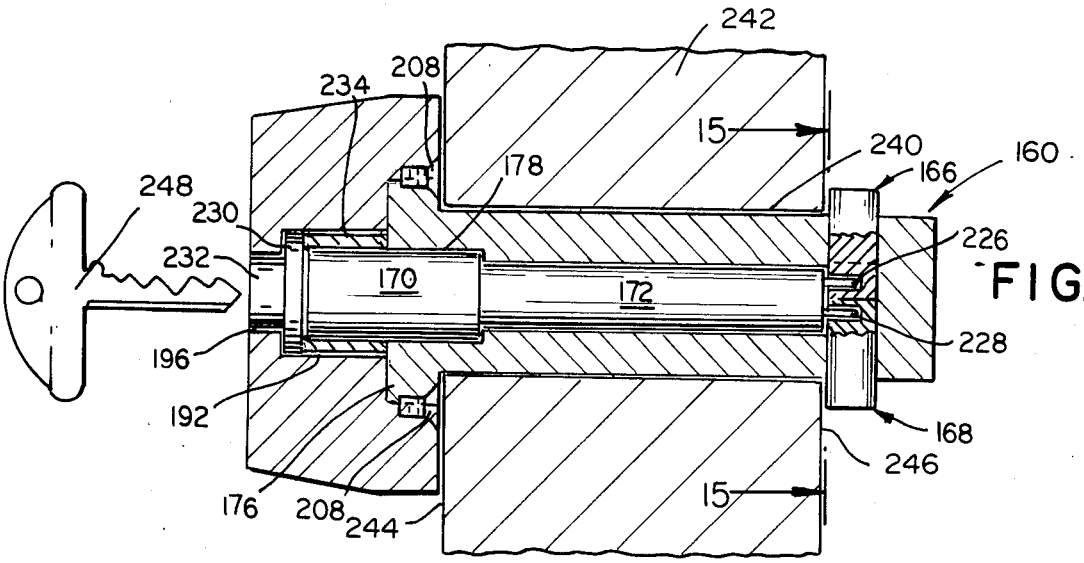
FIG. 12
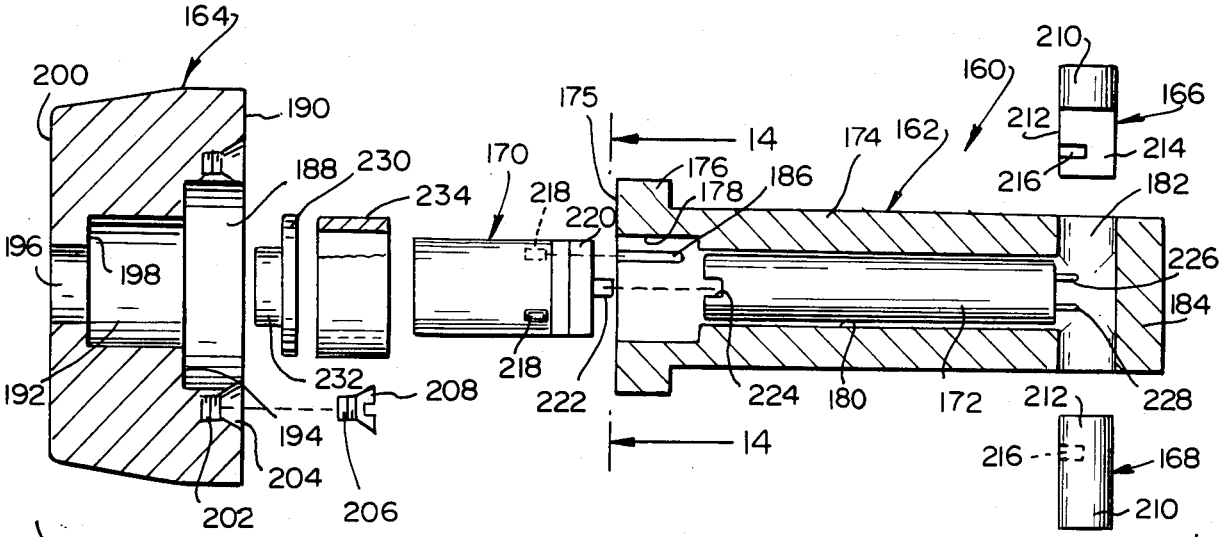
FIG. 13
FIG. 14
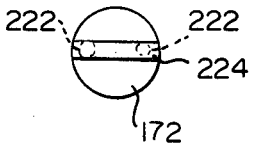
FIG. 16
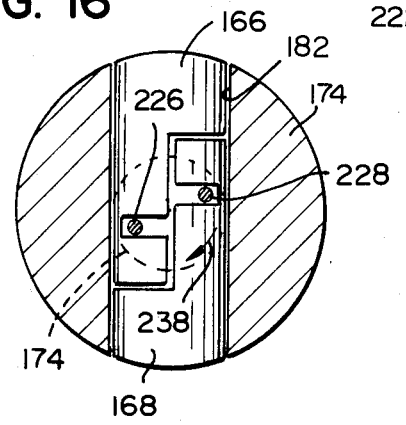
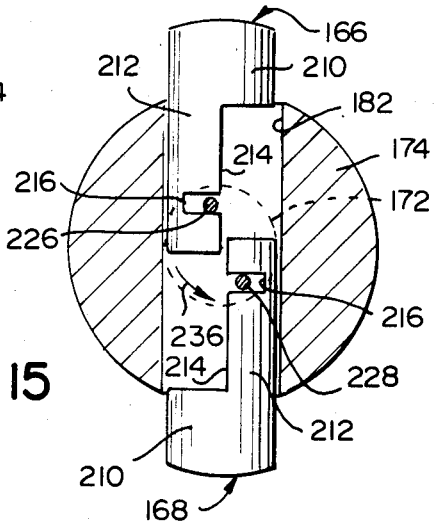
FIG. 15

CONCEALED POST LOCK

BACKGROUND OF THE INVENTION

The present invention relates to improvements in security locking devices, and in particular to a novel and improved lock of the padlock type.

The term "padlock" is used to define a portable and removable lock, the most common of which is a removable lock having a shackle which can be passed through a hasp, staple or link and then secured to fasten a movable member to a fixed member. Padlocks of this shackle type are finding increasing use for high security applications such as for locking store front gates which are presently in common use, and for locking tool lockers used by utility companies for storing expensive tools and equipment.

It has been found by wide experience that padlocks of the shackle type which are available today are subject to inherent weaknesses when under physical attack. One basic weakness is in the exposed shackle which can be easily cut with commonly available tools. In addition, frequent assaults upon the locks have shown that the lock itself can be used as a tool for easily destroying the hasp or link to which it is attached by torque or leverage force. The security function of conventional padlocks can therefore be easily defeated by burglars or other unauthorized persons.

It is the principal object of the present invention to substitute for conventional padlocks a new type of portable and removable locking device which is herein referred to as a "concealed post lock", which is much more resistant to physical attacks than the strongest available conventional padlocks which have exposed shackles.

Another object of the invention is the provision of a concealed post lock which is formed of a large and thick metal head containing the lock cylinder and a locking post or stem projecting from the head and concealed behind the surface which is locked, so that the post is not exposed to physical attack, and the locking parts are protected by the structure to be secured.

Still another object of the invention is the provision of a concealed post lock of the character described in which the head is the only portion of the lock exposed to attack in the locked condition of the device, and in which the exposed head is of sufficient thickness and strength to protect the contained cylinder from destruction under even the most violent attack with commonly available tools.

Another object of the invention is to provide a concealed post lock of the character described in which the lock is brought to its locking position by inserting its post or stem through a hole in the object to be locked, and in such locking position the entire lock is rotatable so that it cannot be damaged or removed from effective locking condition by the application of torque forces.

Another object of the invention is the provision of a concealed post lock of the character described which has the advantage of being capable of installation in such a way that its enlarged head serves to block rotation or other movement of handles or levers on the door or other member being secured so as to prevent unauthorized operation of such handles or levers.

A further object of the invention is the provision of a concealed post lock of the type described which affords the convenience and flexibility of conventional padlocks, but at the same time is adapted to provide maximum security protection to such diversified applications as store front gates and industrial roll-up doors, tool boxes and lockers, trucks, machinery, and other security-sensitive spaces.

SUMMARY OF THE INVENTION

In accordance with the invention herein, there is provided a concealed post lock which includes a cylindrical post, an enlarged head affixed to one end of said post, and a locking member movably mounted at the other end of said post. A lock cylinder is contained within the cylindrical post and enlarged head and is operatively coupled to the locking member in such a manner that rotation of the cylinder within the post, by insertion of a proper key therein, moves the locking member between an unlocked position in which it is located within the circumference of said post, and a locking position in which it projects beyond the circumference of said post.

In one embodiment of the invention the locking member is an eccentric which is moved into and out of flush registry with the post. In an alternative embodiment the locking member comprises one or more pins which are moved from the interior of the post to a locking position projecting from the circumference of the post.

Additional objects and advantages of the invention will become apparent during the course of the following specification when taken in connection with the accompanying drawings, in which:

BRIEF DESCRIPTION OF THE DRAWINGS

FIG. 1 is a perspective view of a structure having a sliding roll-up door which is locked by a concealed post lock made in accordance with the present invention;

FIG. 1A is an enlarged fragmentary view of the portion of the structure of FIG. 1 containing the concealed post lock, which is shown in greater detail;

FIG. 2 is a section taken along line 2—2 of FIG. 1A, showing the concealed post lock in side elevation, this lock constituting a first embodiment of the invention having an eccentric locking member at the end of the post, which locking member is shown in its locked position;

FIG. 2A is a section similar to FIG. 2 but showing the eccentric locking member in its unlocked position;

FIG. 3 is an enlarged sectional view taken along line 3—3 of FIG. 2;

FIG. 11 is a section taken along line 11—11 of FIG. 3, showing the lock post in its locked position;

FIG. 11A is a section taken along line 11—11 of FIG. 3, showing the lock post in its unlocked position;

FIG. 12 is a side elevational view of a second embodiment of concealed post lock made in accordance with the present invention and having projecting pins as the locking member, the lock being shown inserted in a structure shown in broken line, and interior portions of the lock being also shown in broken line;

FIG. 13 is an exploded side view of the lock of FIG. 12, with portions thereof shown in longitudinal section;

FIG. 14 is a plan view of the operational end of the lock cylinder, as view along line 14—14 of FIG. 13;

FIG. 15 is an enlarged section taken along line 15—15 of FIG. 12, and showing the locking pins in their extended, locking position; and FIG. 16 is an enlarged section similar to FIG. 15, but showing the locking pins in their unlocked position.

DESCRIPTION OF THE PREFERRED EMBODIMENTS

Figure 4:
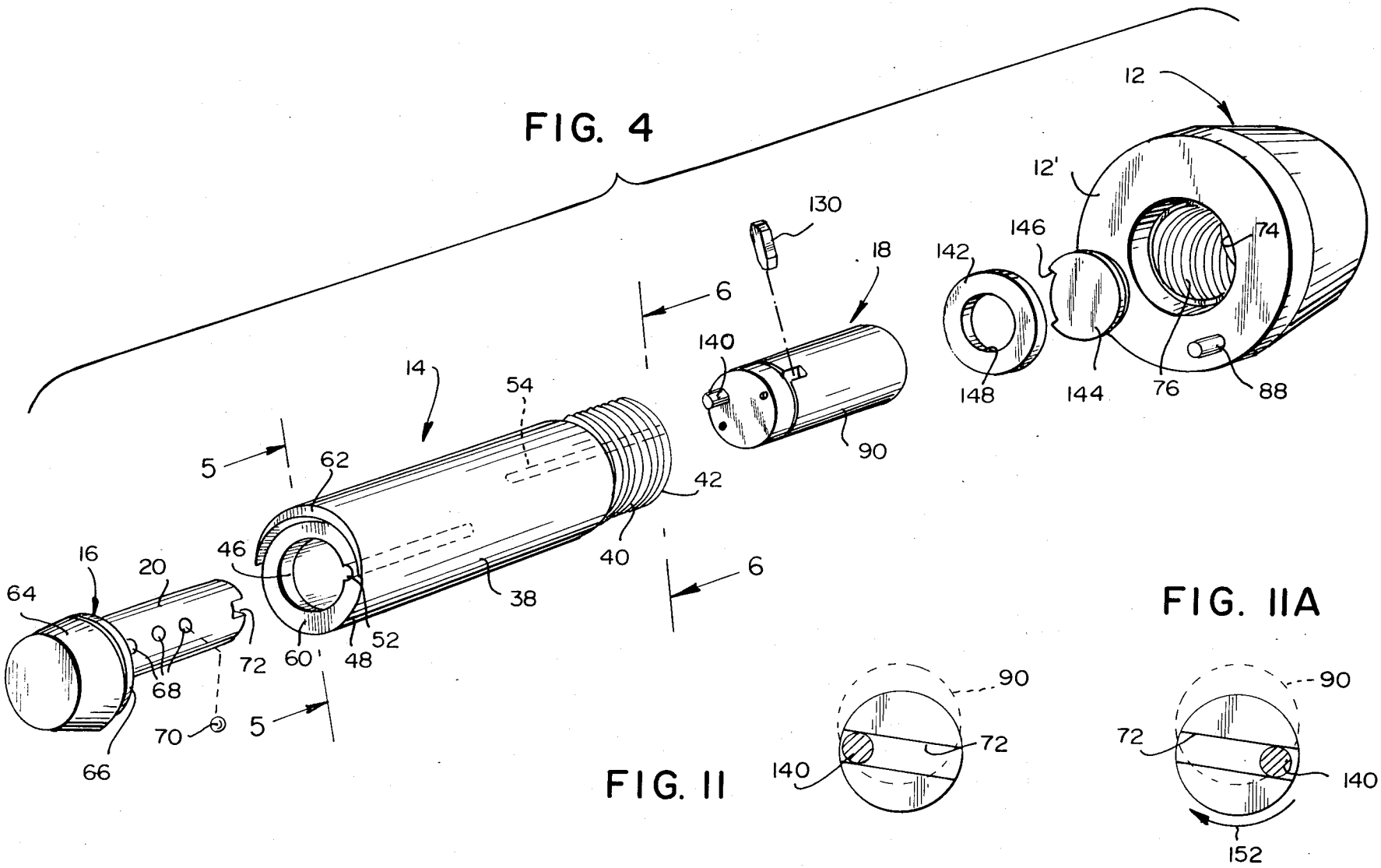
FIG. 4 is a exploded perspective view of the concealed post lock of FIGS. 1 to 3.

Referring in detail to the drawings, there is shown in FIGS. 1–7 a first preferred embodiment of a concealed post lock 10 made in accordance with the present invention. For a better understanding of the constructional details of the lock which will be presently described, it may be explained here that the concealed post lock 10, shown in assembled form in FIGS. 2, 2A and 3, generally comprises an enlarged solid head member 12 of circular cross section, a cylindrical post member or stem 14 affixed to the head member 12 and projecting from the rear surface thereof, and an eccentric locking member 16 rotatably mounted at the free rear end of the post member 14. The head member 12 and affixed post member 14 contain an internal lock cylinder 18 (FIG. 3) which, when actuated by an inserted key, rotates the shank 20 of the eccentric locking member 16 to cause the latter to turn between an unlocked position (shown in FIG. 2A) in which the eccentric member 16 is in flush registry with the outer circumference of the post member 14, and a locking position (shown in FIG. 2) in which the eccentric member 16 is out of alignment with the post member 14 and projects beyond the circumference of the latter.

FIGS. 1 to 2A illustrate the manner in which the concealed post lock 10 is utilized to lock two elements together. By way of illustration, there is shown in FIG. 1 a building structure 22 having a door opening 24 closed by a sliding door 26 formed of hinged panels 28. The sides of the sliding door 26 extend slidably within slots or tracks 30 formed in the sides of the frame 32 bordering the door opening 24. When the concealed post lock 10 is to be installed, a circular bore 34 is drilled through the door frame 32 and the closed sliding door 26, as shown in FIGS. 2 and 2A, the bore 34 being of slightly larger diameter than the diameter of the lock post member 14. To secure the sliding door 26 in its closed condition, the post member 14, with the eccentric member in its unlocked registering position, is slid from the front of the door through the bore 34 until the head member 12 abuts the front surface of the door. The post member 34 is made of sufficient length so that in this inserted position the rear end of the post member, and the eccentric locking member 16 mounted thereon, extends beyond the rear surface of the door frame 32, as shown in FIG. 2A. With the lock in this inserted position, a key is inserted into the keyhole 36 of the lock cylinder 18 and turned to move the eccentric locking member 16 to its locking position in which the eccentric member 16 is offset from the circumference of the post member 14 and overlies the inner surface of the door frame 32 in the manner shown in FIG. 2. The key is then withdrawn and carried away, leaving the inserted and locked concealed post lock 10 firmly securing the closed sliding door 26 to the fixed door frame 32, so that the sliding door 26 cannot be raised and opened. In the enlarged sectional view of FIG. 3 the locking position of the eccentric locking member 16 is shown in full line, while the unlocked position of th eccentric member is shown by the broken line representation 16'.

It will be seen in FIG. 2 that in the locked condition of the concealed post lock 10, the enlarged head member 12 overlies the front surface of the door frame 32, while the extended eccentric member 16 overlies the rear surface of the door frame. The lock 10 is therefore restrained against appreciable longitudinal movement in either direction through the bore 34, and therefore cannot be removed by pushing or pulling either through the front of the door or the rear thereof. The entire lock 10 is, however, rotatably movable within the bore 34. As will be best seen in FIGS. 1 and 1A, the head member 12 of the mounted lock 10 is the only part of the lock visible or accessible at the front of the door, and the post member 14 and eccentric locking member 16 are completely concealed from the outside of the door, and are not exposed to attack, being covered over and protected by the door 26 and frame 32 themselves.

The head member 12 and post member 14 are made as separate parts, and are both thick, sturdy members made of strong, impact-resistant metal such as case hardened steel. The post member 14 comprises a cylindrical body 38 provided with external threading 40 at the forward end 42 thereof. A central bore 44 of circular cross-section extends through the front end 42 and extends longitudinally through about half the length of the post member body 38, communicating with an offset bore 46 which extends through the rear end 48 of the body 38.

Figure 7:
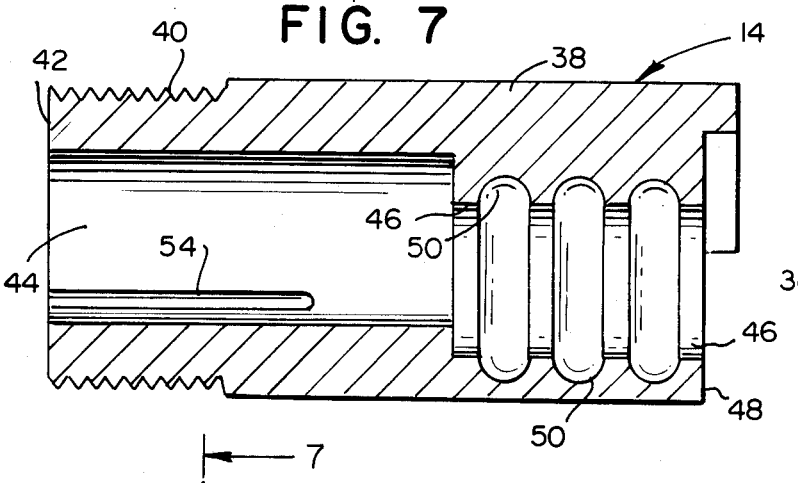
FIG 7 is a section taken along line 7—7 of FIG. 6.
Figure 5:
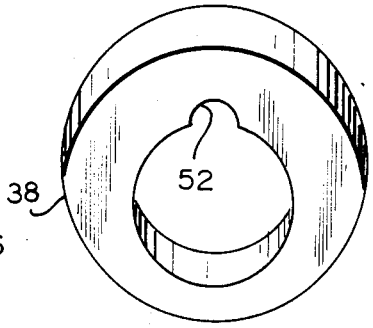
FIG. 5 is an enlarged perspective view of one end of the lock stem as viewed along line 5—5 of FIG. 4.

At least one annular ball raceway 50 of semi-circular cross-section is formed on the inner surface of the post member body 38 within the central bore 44, three such raceways 50 being shown in FIGS. 3 and 7 by way of illustration, although it has been found that only one raceway may serve advantageously. The raceways 50 serve to hold the inserted shank 20 of eccentric locking member 16 in mounted position against longitudinal movement in a manner to be presently explained. A longitudinal groove 52 of semi-circular cross-section is also formed on the inner surface of the post member body 38. The groove 52 extends through the rear end 48 of the post member body and communicates with the raceways 50, as shown in FIG. 7. The groove 52 serves as a keyway through which ball bearings 70 may be inserted in the raceways 50 during assembly of the lock.

Figure 6:
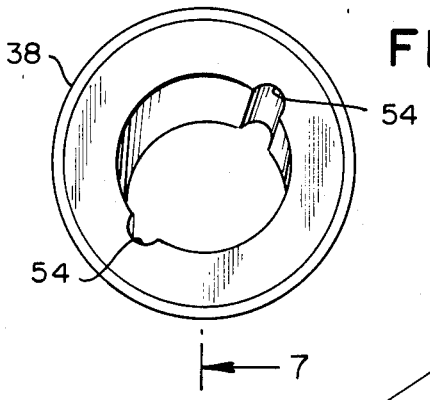
FIG. 6 is an enlarged perspective view of the opposite end of the lock stem as viewed along line 6—6 of FIG. 4.

At its forward end 42, the body 38 is formed with a pair of diametrically-opposed semi-circular grooves 54 which extend longitudinally along the surface of the central bore 44, as shown in FIGS. 4, 6 and 7. These grooves 54 are sized and positioned to receive the locking pins of an inserted lock cylinder in a manner to be explained in greater detail hereinafter.

At the rear end 48 of cylindrical body 38, a rear end wall 60 is bordered along a portion of its circumference by a projecting arcuate shoulder 62 forming a segment of a circle, as shown in FIGS. 4 and 7.

FIGS. 3 and 4 illustrate the structure of the eccentric locking member 16 and its shank 20 which is formed integrally therewith. The eccentric locking member 16 has a main body portion 64 of circular and truncated shape, terminating in a cut-away flange portion 66 from which the shank 20 projects eccentrically. As shown in FIG. 4 the shank 20 is provided with three semi-spherical seats 68 spaced apart by distances corresponding to the spacing distances between the three raceways 50 in the post body 38. For convenience, only one of these seats 68 is shown in FIG. 3. Each semi-spherical seat 68 is sized to receive a ball bearing 70 which rolls within one of the raceways 50, as shown in FIG. 3. At its inner end opposite the eccentric main body portion 64, the shank 20 is formed with a relatively deep rectangular slot 72 which extends diametrically thereacross.

The head member 12 comprises a body of frusto-conical shape formed with a longitudinal bore 74 having internal threading 76 and terminating at the forward end of the head member 12 in a stepped shoulder 78 bordering a front circular opening 80 of relatively small diameter. In assembling the concealed post lock 10, the head member 12 is screwed upon the post member 14 with its internal threading 76 engaging the external threading 40 of the post member, and is then secured in mounted position by a screw 82 turned through a threaded bore 84 which extends angularly through the body of head member 12, as shown in FIG. 3. The screw 82 is turned until it engages and bites into the external threading 40 on the post member 14, and the threaded bore 84 is then closed off by a plug 86. The head member 12 is also provided with a shear pin 88 which projects from its rear wall 12'.

Figure 8:
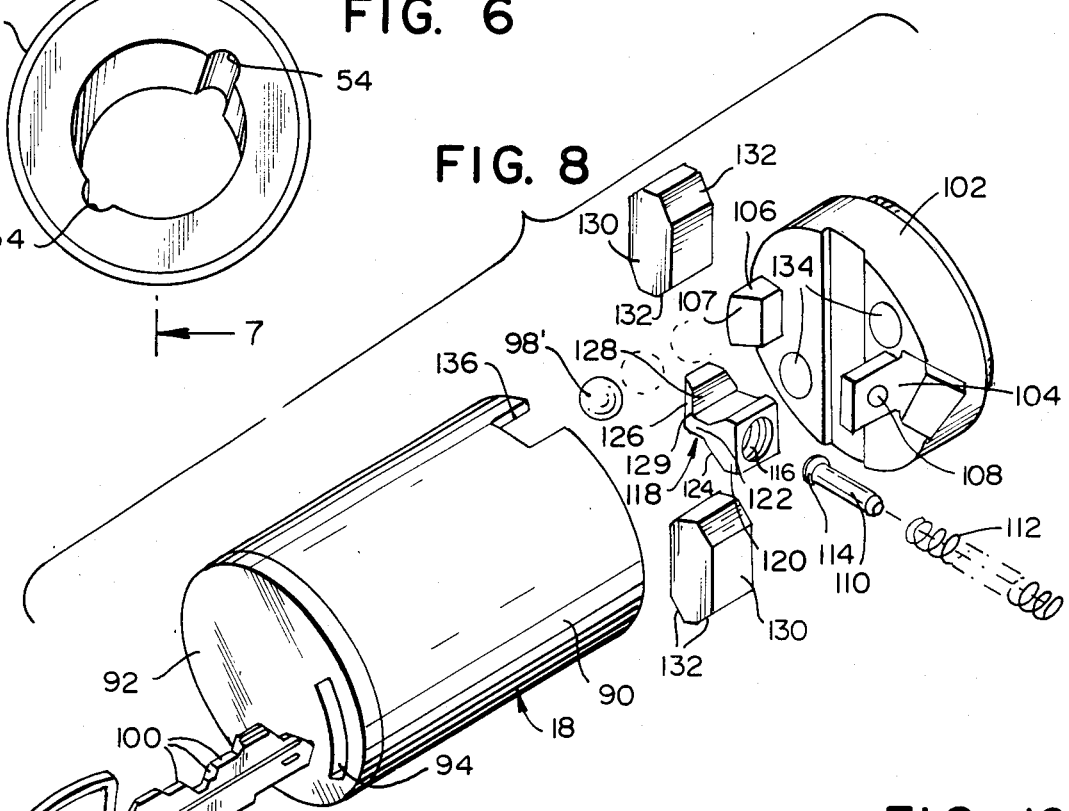
FIG. 8 is an enlarged exploded perspective view of the locking cylinder of the concealed post lock of FIGS. 1 to 7.
Figure 9:
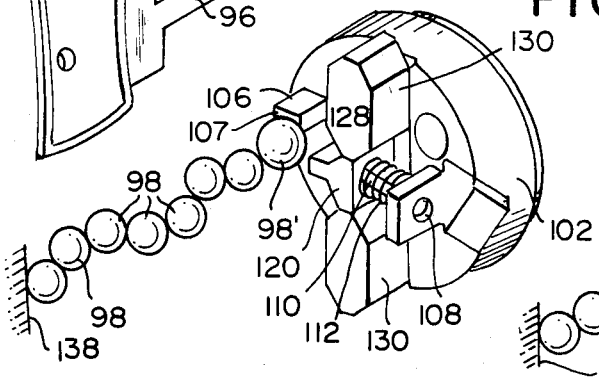
FIG. 9 is an enlarged perspective view of the assembled rear end portion of the cylinder of FIG. 8, showing the line of ball elements which actuate the cylinder mechanism, the balls being shown in this view in their inactive position.
Figure 10:
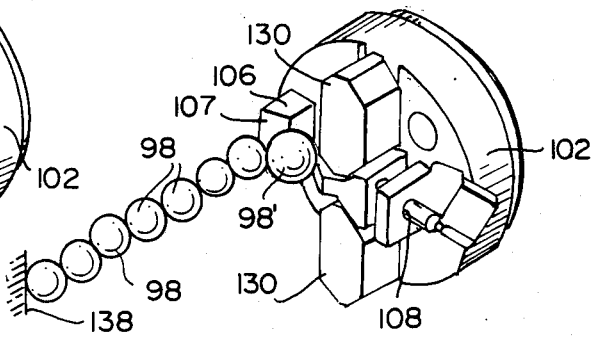
FIG. 10 is an enlarged perspective view of the assembled rear end portion of the cylinder, similar to FIG. 9, but showing the ball elements in their aligned, lock-opening position.

The internal lock cylinder 18 may be of any conventional or standard cylinder constuction in which the insertion and turning of an inserted key will enable it to rotate the eccentric locking member 16 between its locking and unlocking positions. For purposes of illustration; a preferred type of cylinder 18 is shown in FIGS. 8–10, which cylinder is pick-proof and operates upon the principle of aligning a row of balls into a straight line, rather then raising and lowering the usual pins having a shear line. Cylinders of this aligned ball type are shown and described in applicant's U.S. Pat. Nos. 3,928,993 and 3,968,668 to which reference is made for further disclosure, and therefore FIGS. 8–10 herein illustrate the cylinder mechanism only partially and schematically.

As shown in FIG. 8, the lock cylinder 18 includes a cylinder barrel 90, in the front wall 92 of which is formed a key slot 94 of arcuate shape sized to receive a key 96 of corresponding shape. The key slot 94 is located adjacent to the periphery of the front wall 92 and communicates with an internal keyway (not shown) within which a row of spherical balls 98 are mounted in such a position as to be engaged by the ridges and dwells 100 of the key 96 so that when the proper key is inserted, the balls are moved thereby from the unaligned, inactive position shown in FIG. 9 to the straight-line, active position shown in FIG. 10. At its rear end, the row of balls 98 terminates in a ball 98' of larger diameter.

Within the opposite, rear end of the cylinder barrel 90 there is affixed a closure member 102 of cylindrical shape, on the inner wall of which is formed a projecting rectangular plate 104 and a spaced projecting lug 106. The plate 104 contains a circular opening 108 within which a pin 110 is slidably mounted. Mounted on the pin 110 is a coil spring 112. One end of pin 110 terminates in an enlarged head 114 which seats within a circular recess 116 in a bolt 118. This bolt 118 has a front end portion 120 of square shape containing the circular recess 116, and which is joined to a flat narrow intermediate portion 122 by inclined walls 124. The opposite end of the flat intermediate portion 122 is joined to a rear end portion 126 of greater height by inclined walls 128. The rear end portion 126 has an inclined cam surface 129 which faces away from the body of the closure member 102. The lock cylinder 18 also includes a pair of identical locking pins 130 of generally rectangular shape but having inclined or roof-shaped top and bottom surfaces 132.

The closure member 102 is provided with a pair of circular openings 134 through which screws (not shown) are inserted for securing the closure member 102 against the rear wall of the cylinder barrel 90. A deep rectangular slot 136 is formed in the rear wall of barrel 90, the slot being of sufficient size to permit the locking pins 130 to slide therein between a retracted position (shown in FIG. 10), in which the locking pins 130 are located within the confines of the barrel 90, and an extended position (shown in FIG. 9), in which the locking pins 130 project from the periphery of the barrel 90.

FIG. 8 shows the lock cylinder 18 parts in exploded condition, while FIGS. 9 and 10 show the cylinder parts in assembled condition. FIG. 9 illustrates the cylinder parts in their locked position, in which the locking pins 130 project from the body of cylinder barrel 90 and enclosure member 102. In this locked position the locking pins 130 rest upon the enlarged rectangular front end portion 120 of the bolt 118. The bolt 118 is held in this pin-separating position by the tension of the coil spring 112 which surrounds the pin 110. In this position, the bolt 118 is pressed against the lug 106. As shown in FIG. 8, the lug 106 has an inclined cam surface 107 which faces away from the body of the closure member 102. In the locked position of the cylinder parts shown in FIG. 9, this inclined cam surface 107 is aligned with and proximate to the inclined wall 128 of the bolt 118, forming therewith a V-shaped cam seat within which the large ball 98' rests.

The row of balls 98 and the enlarged ball 98', are mounted within the cylinder barrel 90 in alignment with the fixed lug 106 on the closure member 102. In their inactive position shown in FIG. 9, the row of balls 98 are staggered at different horizontal levels so that they exert no force against the lug 106 or the bolt 118 through the enlarged ball 98'.

When the proper key is inserted through the key slot 94 and pushed to a fully-inserted position within the external keyway (not shown), the balls 98 are moved into their active position of FIG. 10 in which they form a horizontally-aligned chain or link of increased length. As the key 96 is slid through the keyway, the ridges and dwells 100 thereon raise and lower the balls 98 to various horizontal levels relative to each other, and when the key is finally pushed inwardly to its fully inserted position, the balls 98 and 98' are moved to their active position of FIG. 10 in which the diameter of each ball is aligned with the diameters of the adjacent balls. The innermost ball 96 of the row of balls is in abutment with an internal wall 138 of the cylindrical barrel 90, while the outermost ball 98 at the opposite end of the row of balls is in engagement with the enlarged ball 98'. When the row of balls is brought into diametrical alignment, they form an aligned chain or link of increased length extending from the wall 138 to the enlarged ball 98'. As this chain or link of increased length is formed, it exerts a force in a direction parallel to the longitudinal axis of the cylinder barrel 90 against the enlarged ball 98', pushing the latter firmly against the projecting lug 106. This force causes the ball 98' to move laterally along the inclined cam surface 107 of the fixed lug 106 from the position shown in FIG. 9 to the position shown in FIG. 10. In this lateral movement the ball 98' presses firmly upon the inclined cam surface 129 of bolt 118, causing the bolt to move in a direction away from the lug 106 to the position shown in FIG. 10, with the pin 110 slidng through the circular opening 108 and the coil spring 112 being compressed between the bolt 118 and the projecting rectangular plate 104. As the bolt 118 moves to this release position, the inclined bottom surfaces 132 of the locking pins 130 slide along the inclined walls 128 of the bolt 118, so that the locking pins 130 move to their retracted positions in which they are seated upon the narrow intermediate portion 122 of the bolt 118, and their outer ends are recessed within the confines of the cylinder barrel 90.

As shown in FIG. 4, a pin 140 projects from the outer surface of the closure member 102. In the mounted position of the cylinder 18 within the post member 14, the pin extends into the rectangular diametric slot 72 in the end of eccentric member shaft 20, as shown in FIGS. 11 and 11A. Such pin and slot connection causes rotational movement of the cylinder barrel 90 to turn the eccentric locking member 16, in a manner to be presently described.

The concealed post lock 10 also includes a washer 142 and a circular cylinder cover 144 which are used in assembling the lock parts. The cylinder cover 144 is formed with a peripheral cut-out portion 146 which is sized to register with the cylinder key slot 94. The washer 142 has a central circular aperture 148 of smaller diameter than the cylinder barrel 90.

In assembling the lock 10, a ball bearing 70 is placed in one or more of the semi-spherical seats 68 in the eccentric member shank 20 and the shank 20 is introduced into the offset bore 46 of the post member 14, with the ball bearing 70 aligned with and sliding through the groove 52 of the post member, in the manner indicated in FIG. 4. The eccentric locking member is pressed to its fully inserted position shown in FIG. 3 in which the ball bearing 70 is located within the appropriate annular ball raceway 50 within the cylindrical body 38 of post member 14. The eccentric main body portion 64 is now turned to its unlocked position shown at 16' in broken line in FIG. 3, in which the eccentric main body portion 64 is flush with the outer circumference with the post member 14 and does not project therefrom. In this position, the inner surface of the eccentric body portion 64 rests slidably upon the rear end 48 of the post member body 38 and the cut away flange portion 66 of the eccentric body portion 64 is in circumferencial alignment with the arcuate shoulder 62 of the post member body 38, constituting a continuation thereof. When the eccentric member 16 is turned to this unlocked position, the ball bearing 70 rolls along the raceway 50 to a location remote from the longitudinal groove 52 so that said ball bearing 70 locks the eccentric shank 20 in the fully inserted position and the eccentric locking member 16 can no longer be moved longitudinally within the post member 14. It will be observed in FIG. 3, that in this fully inserted position, the end wall of the eccentric member shank 20 is substantially flush with the inner end of the offset bore 46. It will be understood that when the eccentric locking member 16 is turned to its unlocked position, the ball bearing 70 is moved along the raceway 50 to a position remote from the longitudinal groove 52, and that in subsequent operation of the lock, the eccentric 16 is never turned far enough to bring the ball bearing 70 back into registry with the groove 52, so that the eccentric member 16 is permanently locked in its fully inserted position and can not be withdrawn longitudinally therefrom.

The cylinder barrel 90 is then inserted from the forward end 42 of the post member body 38 into the central bore 44, with the locking pins 130 (FIG. 9) projecting from the cylinder barrel 90 and entering and sliding through the diametrically-opposed semi-circular grooves 54 of the post member 14. With the locking pins 130 received within these bores 54, the cylinder 18 is locked against rotation within the post member 14. In this inserted position of lock cylinder 18, its end projecting pin 140 (FIG. 3) enters the rectangular slot 72 in the end wall of the eccentric shank 20, as shown in FIGS. 3, 11 and 11A. In the fully inserted position of the cylinder barrel 90, the front wall 92 of the cylinder barrel 90 is flush with the forward end 42 of the post member cylindrical body 38, as shown in FIG. 3. The cylinder barrel 90 is secured within the central bore 44 by insertion of the washer 142 against the post body forward end 42 and the placement of the cylinder cover 144 thereupon with the cut-out portion 146 registering with the keyhole 36 of the cylinder.

The head member 12 is now inserted upon the post member 14 and screwed to its fully inserted position by means of its internal threading 76 engaging the external threading 40 of the post member cylindrical body 38. The head member 12 is locked in this mounted position by insertion of the screw 82 through the annular threaded bore 84 of head member 12 and closing off the threaded bore 84 by means of the plug 86 shown in FIG. 3. It will also be seen in FIG. 3 that the circular body of cylinder cover 144 fits snugly within the stepped shoulder 78 of the head member 12, and that the cylinder cover 144 has a circular extension 148' which fits within the front circular opening 80 of the head member 12.

The assembled concealed post lock 10 may now be utilized to lock a door, lid or other movable member to a fixed member, such as the locking of the sliding door 26 to the door frame 32 in the manner shown in FIGS. 1 to 2A and previously described. With the eccentric member 16 in its flush, unlocked position, and the key 96 inserted in the lock cylinder 18, the cylindrical post member or stem 14 of the post lock 10 is inserted through the circular bore 34 of the door 26 and frame 32 and the key 96 is turned within the cylinder 18 to cause the eccentric member 16 to move to its locked position. If the head member 12 is provided with the projecting shear pin 88, this pin 88 would be received snugly within a small recess 150 provided in the door frame 32 as shown in FIG. 2A, the pin and recess preventing the head member 12 from rotating during the turning of the key 96. This optional feature is merely a convenience to the user, and if a strong torque force is applied to the exposed head member 12 by an unauthorized person, the shear pin 88 will snap off, allowing the head member 12 an the remainder of the post lock 10 to turn freely within the bore 34. Such turning movement will not interfere with the security of the lock.

When the key 96 is pressed inwardly, it moves the row of balls 98 within the cylinder 18 to their aligned, active position of FIG. 10, causing the locking pins 130 to move to their retracted positions in the manner previously described. The locking pins 130 are thus withdrawn from engagement with the grooves 54, and the cylinder 18 is thereby released from the post member 14 and may turn freely within the central bore 44 thereof. When the key 96 is now turned in a clockwise direction, it turns the cylinder barrel 90 in the same direction within the central bore 44 of post member 14, causing the cylinder pin 140 to travel within the slot 72 in the end of eccentric member shank 20.

It will be observed in FIGS. 11 and 11A that the coupling of the cylinder 18 to the eccentric member 16 by means of the pin 140 and slot 72 provides a Geneva-type movement which enables a short turning movement of the key 90 and cylinder 18 to be translated into an appreciably longer turning movement of the eccentric locking member 16. In the unlocked, flush position of the eccentric main body portion 64 shown in FIG. 11A, the pin 140 is located at the right-hand end portion of the slot 72. When the cylinder barrel 90 is turned clockwise in the direction of the arrow 152 shown in FIG. 11A, the pin 140 turns the slot 72 and moves to the opposite end thereof, to the position shown in FIG. 11. This represents a turning movement of the cylinder barrel 90 of approximately ninety degrees. On the other hand, the eccentric body portion 64 and the eccentric shank 20 are turned through an angle of approximately one hundred and eighty degrees from the flush, unlocked position shown in FIG. 2A to the projecting, locked position shown in FIG. 2. When the eccentric member 16 has been turned to its locked position, the key 96 is removed and carried away, such key removal causing the chain of balls 98 to move to their staggered, unaligned position shown in, FIG. 9 and releasing longitudinal pressure upon the large ball 98'. The coil spring 112 therefore biases the bolt 118 to the pin-separating position shown in FIG. 9, and the locking pins 130 are pushed to their projecting positions in which they enter the grooves 52 and lock the barrel to the post member 14. In the absence of the key 96, the lock cylinder 18 cannot be rotated within the post member 14 and the eccentric locking member 16 is securely maintained in its locked, projecting position. With the concealed post lock 10 so secured, only the head member 12 is exposed at the exterior of the structure being locked, and the post member 14 and eccentric locking member 16 are concealed within and behind the locked structure and are protected by the structure itself from the application of attack forces thereon.

The pin and slot coupling provided by the pin 140 of cylinder 18 and slot 72 of eccentric locking member 16 also serves as means for protecting the concealed post lock from unauthorized opening by force. If, in an intended burglary, access should be obtained to the rear of the lock and a strong torque force applied to the eccentric locking member 16 in an effort to open or damage the lock, such torque force will not be applied in a rotary direction upon the cylinder 18. The heavy torque force upon the eccentric locking member 16 is transferred through the slot 72 to the pin 140 of cylinder 18, but since the eccentric member and the cylinder are turnably mounted about offset axes of rotation, only a small vector of the force is applied to the pin 140 in a torque direction, and the major force vector is directed against the mass of the cylinder body. Thus the cylinder 18 does not receive such a strong torque force as may cause opening of the locking pins 130 or damage the internal cylinder mechanism.

In FIGS. 12 through 15 there is shown a second embodiment of concealed post lock 160 made in accordance with the invention, which post lock provides the locking action by means of a plurality of sliding pin locking members rather than the eccentric member of the embodiment previously described.

The concealed post lock 160 is shown in exploded form in FIG. 13, wherein it will be seen that the lock assembly generally includes a cylindrical post member or stem 162, an enlarged head member 164, a pair of slidable pin locking members 166 and 168, an internal lock cylinder 170, and an elongated cylindrical coupling shank or rod 172.

The post member 162 has a cylindrical body 174 having at its inner end 175 an integral annular flange 176 of enlarged diameter, and a bore 178 of circular cross-section extending centrally through said flange and into the interior of the post member body 174. The bore 178 communicates with a longitudinal bore 180 of smaller diameter which extends centrally through the major length of the post member body 174 and communicates with a through bore 182 extending diametrically through the body 174 proximate to the outer end 184 of the latter. Within the bore 178 there is formed a pair of longitudinally-extending grooves or keyways 186.

The head member 164 is similar in size and shape to the head member 12 of the previous embodiment, having a body of frusto-conical configuration formed with a cylindrical bore 188 extending inwardly from its rear wall 190. The bore 188 communicates with a cylindrical intermediate bore 192 of smaller diameter, forming a shoulder 194 therewith. The intermediate bore 192 in turn communicates with a bore 196 of smaller diameter, forming a shoulder 198 therewith, and said bore 196 extends through the front wall 200 of the head member 164. Four threaded screw holes 202 (two of which are shown in FIG. 13) are formed in the rear wall 190 of the head member 164, these holes 202 surrounding the cylindrical bore 188 and being equally spaced therearound. Each of the screw holes 202 has a conical countersink 204 which overlaps the periphery of the bore 188, as shown in FIG. 13. Each of the screw holes 202 is adapted to receive a respective screw 206 having a tapered head 208.

The pin locking members 166 and 168 are identical in structure, and each comprises a cylindrical metal body which is cut away to form a solid cylindrical outer portion 210 and a semi-cylindrical inner portion 212 have a flat surface 214 provided with a lateral slot 216. The locking members 166, 168 each have a diameter slightly less than the diameter of the bore 82 so that they may be slidably received in the latter.

The cylinder 170 is identical to the lock cylinder 18 shown in FIGS. 8, 9 and 10 and previously described, and operates in the same manner by alignment of a row of contained balls upon insertion of a proper key to move a pair of opposed locking pins 218 from a projecting locking position to a retracted release position. In this embodiment, however, instead of the cylinder having a single offset pin, as in the previous embodiment, the closure member 220 of cylinder 170 has a pair of diametrically spaced pins 222 projecting longitudinally from its end surface. These pins 222 are sized and positioned to be received in a transverse slot 224 at the front end of the coupling shank 172 for rotatably coupling the cylinder 170 to the shank 172.

The coupling shank 172 comprises an elongated solid cylindrical metal rod of such diameter as to fit rotatably within the longitudinal bore 180, and having a length approximately equal to the length of said bore 180. The transverse slot 224 is formed in the front end wall of the shank 172, and a pair of spaced pins 226 and 228 project from the opposite, rear end wall. The pins 226 and 228 are spaced along a diameter of said shank 172, as shown in FIGS. 15 and 16, and are sized to be slidably received in the slots 216 of the locking members 166 and 168.

The concealed post lock 160 also includes a circular cylinder cover 230 similar to the cylinder cover 144 of the embodiment previously described, and comprising a flat circular disk-like body having an integral circular extension 232 of smaller diameter. The extension 232 is sized to fit rotatably within the bore 196 of head member 164, and has a cut-away portion (not shown) for exposing the keyhole of the lock cylinder 170. A cylinder-shielding tube 234 is also provided to protect the lock cylinder 170 from the force of a direct attack, as will be presently described. The tube 234 is made of a strong metal and has a thick annular wall of such diameter as to receive the cylinder 170 snugly therein.

In assembly of the concealed post lock 160, the two slidable pin locking members 166 and 168 are inserted into the through bore 182 of the post member 162 and brought to their locking positions of FIG. 15. The coupling shank 172 is now inserted into the longitudinal bore 180 and turned until its pins 226 and 228 are received within the slots 216 of the locking members 166, 168. The cylinder 170 is then inserted within the circular bore 178, in such position that its locking pins 218 enter and slide within the corresponding grooves or keyways 186, and its projecting pins 222 enter the transverse slot 224 of coupling shank 172, as shown in FIG. 14. In this mounted position of cylinder 170, its forward portion projects outwardly of the post member 162.

The cylinder cover 230 is now inserted into the intermediate bore 192 of the head member 164 until it abuts the shoulder 198 and its circular extension 232 is received snugly within the front bore 196 of the head member 164. The cylinder shielding tube 234 is also inserted into the intermediate bore 192. The post member 162 is now assembled with the head member by sliding the inner end 175 of of post member body 174, with the cylinder portion projecting therefrom, into the cylindrical bore 188 of head member 164. In this assembled position, the integral annular flange 176 of the post member body 174 seats within the bore 188 and rests against the shoulder 194, and the projecting portion of the cylinder 170 extends through the cylinder shielding tube 234 and abuts the surface of the cylinder cover 230. Assembly of the lock is completed by inserting screws 206 into each of the four threaded screw holes 202. The tapered heads 208 of the inserted screws 206 overlap the peripheral edges of the post member annular flange 176, locking said flange 176 within the head member bore 188 and securing the post member 162 rigidly to the head member 164.

When the concealed post lock 160 is fully assembled, as decribed above, the lock is in its locking condition shown in FIG. 15, with the solid cylindrical outer portions 210 of both slidable locking members 166 and 168 projecting outwardly of the post member body 174. In this condition, the cylinder 170 is locked against rotation within the post member 162 and cannot be turned because its locking pins 218 project into the grooves or keyways 186. When the lock is to be used by inserting it through an opening 240 of a member to be locked (FIG. 12), in the manner previously described, the lock must be brought to its unlocked position of FIG. 16 in order to insert the post member 162 through the opening 240. For this purpose, a key 248 is inserted into the keyhole of the lock cylinder 170, causing the locking pins 218 to be retracted from the grooves 186, and the unlocked cylinder is turned by the key in a clockwise direction indicated by the arrow 236 in FIG. 15. This rotary movement of the cylinder 170 moves the pins 226 and 228 in the same clockwise direction, causing the pin 226 to exert a downward force upon the slot 216 of locking member 166, causing the latter to slide downwardly within the bore 182. At the same time, the pin 228 exerts an upward force upon the slot 216 of locking member 168, causing the latter to slide upwardly in the bore 182. The key is turned until the locking members have reached their fully retracted positions shown in FIG. 16, in which they are wholly contained within the bore 182 and their ends are flush with the outer peripheral surface of the post member body 174.

The concealed post lock 160, in its unlocked condition, may now be slid through the opening 240 in the member 242 to be locked, until the rear wall 190 of the head member 164 abuts the front surface 244 of the member 242. The key 248 is now turned in a direction to cause the coupling shank 172 to turn in the counterclockwise direction shown by arrow 238 in FIG. 16, and the pins 226 and 228 function to slide the respective locking members 166 and 168 outwardly to their locking positions of FIG. 15. In this locked position, the cylinder 170 has been turned to a position in which its locking pins 218 register with the grooves or keyways 186. The key 248 is now withdrawn and carried away, causing the locking pins 218 to enter the grooves 186, and leaving the lock in its secured position of FIG. 12, with the extended locking members 166 and 168 overlying the rear surface 246 of the member 242. As in the previous embodiment, when the lock 160 is in its secured position of FIG. 12, only the head member 164 is exposed, and the post member 162 and locking members 166 and 168 are concealed and are protected from attack by the body of the member 242 which is being secured.

The cylinder shielding tube 234 protects the cylinder 170 from damage in case of a direct attack upon the exposed head member of the secured lock. Thus, if the exposed cylinder cover 230 is subjected to the direct blow of a hammer or other tool in a longitudinal direction, the force of such blow is transmitted by the tube 242 to the flange 176 of the post member 162, and the cylinder 170 is thus shielded from the impact of such force.

While preferred embodiments of the invention have been shown and described herein, it is obvious that numerous omissions, changes and additions may be made in such embodiments without departing from the spirit and scope of the invention.

What is claimed is:

1. A concealed post lock comprising:

an elongated cylindrical post member.

a cylindrical heat member of substantially greater diameter than said post member and having a front face and a rear secured to a first end of said post member, locking means movably mounted at a second, opposite end of said post member and including at least one locking member movable between a retracted position in which it is confined within the periphery of said post member, and an extended locked position in which is projects outwardly from the periphery of said post member, a key-actuated locking cylinder mounted within the interior of said post member and said head member, said cylinder including retaining means normally securing said cylinder against rotation within said post member, and means for releasing said cylinder for rotation within said post member, coupling means connecting said cylinder to said locking means for movement of said coupling member from its locking position to its unlocked position in response to rotation of said cylinder within said post member, said locking means includes a circular eccentric locking member having a cylindrical shank projecting from a location offset from a center thereof, said shank being rotatably mounted within said post member with said eccentric locking member slidably engaging said second end of said post member, said eccentric locking member having a diameter substantially equal to a diameter of said post member, said post member having a first longitudinal bore offset from a central axis thereof, and a second longitudinal bar extending centrally within said post member and communicating with said first bore, with and inner end of said cylinder being located proximate to an inner end of said shank, and said coupling means including a pin mounted off-center on an inner end of said cylinder, and a transverse slot extending diametrically across an inner end of said shank for receiving said pin therein.

2. A concealed post lock according to claim 1 in which said pin is sized to slide through said transverse slot upon rotation of said cylinder, whereby to rotate said eccentric shank through a Geneva-like movement in which a short turning movement if said cylinder results in a substantially longer turning movement of said shank and the eccentric locking member carried thereby.

3. A concealed post lock comprising:

an elongated post member, an enlarged head member having a front face and a rear face secured to one end of said post member, locking means movably mounted at the other end of said post member and including at least one locking member, means for moving said locking member between a retracted unlocked position in which it is aligned within a periphery of said post member and an extended locking position in which it projects outwardly from the periphery of said post member, and projecting means affixed to said post member projecting axially past an end of said post member at least beyond an adjacent portion of said locking member whereby withdrawal of said post lock from a hole is discouraged.

4. A concealed post lock according to claim 3 wherein said projecting means is disposed at a tangential location opposite to a direction in which said locking means projects in its locking position.

5. A concealed post lock according to claim 3 wherein said projecting means includes an arcuate shoulder.

6. A concealed post lock according to claim 5 wherein said locking member includes a cut-away flange portion generally fitting said arcuate shoulder when said locking member is in its unlocking position.

7. A concealed post lock according to claim 3 wherein said locking member includes a taper on an external surface thereof effective for enabling insertion thereof into a hole.

8. A concealed post lock according to claim 3 wherein said enlarged head member includes a taper on a peripheral surface thereof for making more difficult an assault thereon.

* * * * *

UNITED STATES PATENT AND TRADEMARK OFFICE

CERTIFICATE OF CORRECTION

PATENT NO. : 4,688,405

DATED : August 25, 1987

INVENTOR(S) : Norman Epstein

It is certified that error appears in the above-identified patent and that said Letters Patent is hereby corrected as shown below:

Column 12, line 65, "heat" should read --- head ---

Column 12, line 67, after "rear" insert --- face ---

Column 13, line 6, "is" should read --- it ---

Signed and Sealed this

Second Day of February, 1988

*Attest:*

*Attesting Officer*

DONALD J. QUIGG

*Commissioner of Patents and Trademarks*